US007020410B2

(12) United States Patent
Zogg et al.

(10) Patent No.: US 7,020,410 B2
(45) Date of Patent: Mar. 28, 2006

(54) GROUNDING PLATE ASSEMBLY FOR A DRUM IN AN IMAGE FORMING APPARATUS

(75) Inventors: Jon P. Zogg, Chesapeake, VA (US); Daniel R. Todd, Chesapeake, VA (US)

(73) Assignee: Mitsubishi Chemical America, Inc., Chesapeake, VA (US)

( * ) Notice: Subject to any disclaimer, the term of this patent is extended or adjusted under 35 U.S.C. 154(b) by 47 days.

(21) Appl. No.: 10/717,555

(22) Filed: Nov. 21, 2003

(65) Prior Publication Data

US 2005/0111870 A1 May 26, 2005

(51) Int. Cl.
*G03G 15/00* (2006.01)

(52) U.S. Cl. ..... 399/90; 399/117

(58) Field of Classification Search ..... 399/88, 399/90, 117, 159
See application file for complete search history.

(56) References Cited

U.S. PATENT DOCUMENTS 5,210,574 A * 5/1993 Kita ..... 399/117
5,729,792 A * 3/1998 Ikehara ..... 399/90
5,845,173 A * 12/1998 Zogg et al. ..... 399/90
5,953,562 A * 9/1999 Kawaguchi et al. ..... 399/117
6,006,053 A * 12/1999 Ikehara ..... 399/90
6,029,019 A * 2/2000 Kawai ..... 399/117 X
6,167,219 A * 12/2000 Miyamoto et al. ..... 399/90
6,249,661 B1 * 6/2001 Saitoh et al. ..... 399/117
6,771,915 B1 * 8/2004 Cais et al. ..... 399/90
6,785,489 B1 * 8/2004 Anderson, II ..... 399/90
2003/0194248 A1 10/2003 Anderson, II

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A photosensitive drum assembly for an image forming apparatus. A drum defines first and second open ends. A flange is partially disposed in the first open end. A grounding plate assembly includes a drum contact member and a shaft contact member. The drum contact member is configured to remove an electrically resistive coating from an interior of the drum. The shaft contact member is configured to contact a grounding shaft. The shaft contact member is disposed entirely within an interior of the flange.

29 Claims, 4 Drawing Sheets

GROUNDING PLATE ASSEMBLY FOR A DRUM IN AN IMAGE FORMING APPARATUS

FIELD OF THE INVENTION

The present invention relates to image forming apparatus, and particularly to an improved contact assembly for a drum, such as a photosensitive drum, for the image forming apparatus. More particularly, the invention provides an improved grounding plate assembly for the photosensitive drum.

DISCUSSION OF THE RELATED ART

An image forming apparatus, such as a printer, a photocopier, and the like, includes a photosensitive member, typically in the form of a photosensitive drum. The performance of the photosensitive drum is of critical importance, since the image being produced (or reproduced) is formed and developed on the drum. The developed image is then transferred from the drum to, e.g., a sheet of paper. Typically, the drum is formed of metal such as aluminum, and the metal is anodized or coated to provide a thin dielectric layer. The drum is then coated with photogeneration and photoconduction layers over the dielectric layer.

In forming an image, an electrostatic image is formed on the drum, and that image is developed with a developing medium, such as toner. Since the image is formed electrostatically, it is extremely important that any undesired charges or built-up charges are removed, or grounded from the drum utilizing a grounding expedient. This grounding must occur despite the anodized or coated layers which can be disposed on the drum, and which act as insulators.

In a known grounding arrangement, a grounding plate is fastened to a flange which extends into one end of the photosensitive drum. The flange is secured in place with, for example, an adhesive. This flange includes two radial projections, which make contact with an inner surface of the photosensitive drum. In addition, to provide better contact, a portion of the inner surface of the photosensitive is scribed, for example, utilizing a laser. The scribing will cut through the anodized layer (or other coatings or oxidized surfaces which reduce conductivity), so that the drum can be grounded by the grounding plate. One of the radial projections of the grounding plate is aligned with this scribed patch, to thereby ensure satisfactory contact and conductivity between the photosensitive drum and the grounding plate. The grounding plate also includes an inwardly projecting contact member, which makes contact with a shaft which extends through the drum flange. The shaft is grounded, and thus, the photosensitive drum is also grounded to the shaft by way of the grounding plate.

The laser scribing can be time consuming, and therefore it is desirable to provide only a relatively small laser scribed patch. When the flange is inserted into the drum, a projection of the grounding plate must be aligned with the laser scribed patch.

The above arrangement can be unsatisfactory due to the requirement for the radially projecting contact element to be aligned with the scribed patch formed on the inner surface of the photosensitive drum. If a radially extending projection does not contact with the scribed portion or contact area on the interior of the drum, although a certain amount of grounding might take place, it is certainly less than optimal. As a result, the drum will not function or will provide inferior image quality. Since inferior images can result from a wide array of problems, this problem is also difficult to detect, and results in an overall perception of inferior image forming products. Thus, prior arrangements have been problematic in that they rely upon the care of the laborer in inserting the flange into the end of the drum to ensure that the contact projection of the grounding plate is aligned with the contact area of the interior surface of the drum. Moreover, even if care has been taken in aligning the contact projection of the grounding plate with the contact surface on the interior of the drum, any movement of the flange after insertion (e.g., if the flange should move before the adhesive utilized in securing the flange to the drum has cured), inferior contact can nevertheless result. The requirement to align the contact projection of the grounding plate with the contact area on the inner surface of the drum also presents a complication or obstacle to automation. If an automated insertion is to be utilized with prior grounding plate arrangements, the equipment must provide for alignment of the contact projection with the contact area (e.g., the laser scribed patch) formed on the inner surface of the drum.

BRIEF SUMMARY OF THE INVENTION

It is an object of the present invention to provide an improved contact assembly for an image forming apparatus.

It is another object of the invention to provide an improved assembly for grounding or removing a change from a photosensitive drum.

It is a still further object of the invention to provide an improved contact assembly and photosensitive drum for an image forming apparatus in which the contact assembly, or grounding plate, ensures that advantageous contact is made between the grounding plate and the interior surface of the photosensitive drum, regardless of the rotational or angular position of the flange with respect to the photosensitive drum.

The above and other objects and advantages are achieved in accordance with the present invention by providing a photosensitive drum assembly for an image forming apparatus. A drum defines first and second open ends. A flange is partially disposed in the first open end. A grounding plate assembly includes a drum contact member and a shaft contact member. The drum contact member is configured to remove an electrically resistive coating from an interior of the drum. The shaft contact member is configured to contact a grounding shaft. The shaft contact member is disposed entirely within an interior of the flange.

The present invention further provides an image forming apparatus including a drum assembly. In the assembly, a drum defines first and second open ends. A flange is partially disposed in the first open end. A grounding plate assembly includes a drum contact member and a shaft contact member. The drum contact member is configured to remove an electrically resistive coating from an interior of the drum. The shaft contact member is configured to contact a grounding shaft. The shaft contact member is disposed entirely within an interior of the flange.

BRIEF DESCRIPTION OF THE DRAWINGS

Other objects and advantages of the present invention will become readily apparent as the same becomes better understood with reference to the following detailed description, particularly when considered in conjunction with the drawings in which.

DETAILED DESCRIPTION OF THE PREFERRED EMBODIMENTS OF THE INVENTION

Figure 1:
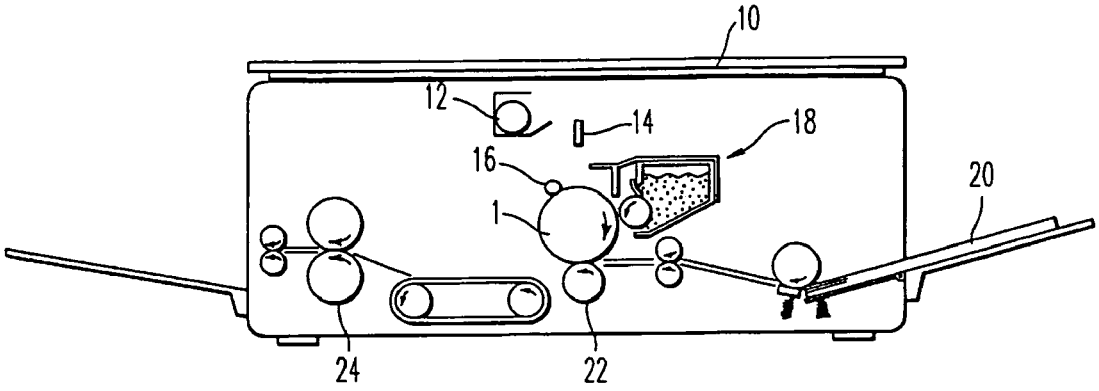
FIG. 1 schematically represents a photocopier to which the present invention is applicable.

FIG. 1 schematically represents an image forming apparatus in the form of a photocopier to which the present invention is applicable. In such an arrangement, an original document is placed upon the photocopier glass 10, and is illuminated by a lamp 12. The resulting light is then projected onto a photosensitive drum 1 by way of an optical system 14, and the drum has been previously charged utilizing, for example, a charge roller 16. As a result, an electrostatic latent image is formed on the drum 1, and this image is developed by toner of a developing unit 18, which supplies toner to the drum 1. Paper is fed from a source 20 by various rollers to a location between the drum 1 and a backup roller 22, so that the toner image of the drum is transferred to the paper. The paper is then fed to a fixing device 24 which, typically utilizing heat, fixes the toner image to the paper, and the paper is then conveyed out of the apparatus. If the photosensitive drum 1 is not properly grounded, the images are not formed or are inferior in that one or more of the initial charging by charge roller 16, formation of a latent image utilizing the optical system 14, developing and/or cleaning (removal of residual toner from the drum by a cleaning device not shown) can be less than optimal. Moreover, due to the number of components of the apparatus, it can be difficult to determine the cause of inferior images. Even if the image inferiority is isolated to the photosensitive drum, the inferior images could be attributed to simple product inferiority of the drum including, for example, the materials utilized in forming the photoreceptor surface of the drum. However, inferior images can be attributable to less than optimal grounding of the photosensitive drum, but it is difficult to detect the cause of inferior images, and the user/purchaser is simply left with an overall perception of poor product quality. Thus, it is important to provide reliable grounding or charge removal, to reduce the occurrence of inferior images and to also simplify troubleshooting when inferior images should occur.

Figure 2:
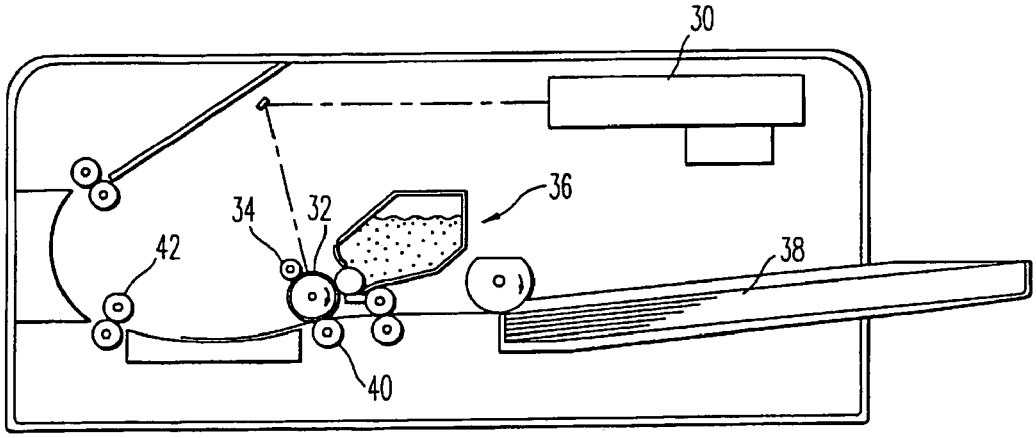
FIG. 2 schematically represents a printer to which the present invention is applicable.

FIG. 2 schematically represents a printer device to which the present invention is also applicable. As shown in FIG. 2, in contrast to the photocopier device, the printer provides an image by way of a control unit which provides a video signal, for example, by a laser scanning unit 30. The laser scanning unit 30 thus provides a latent image onto the photosensitive drum 32, which has been uniformly charged with a charge roller 34. The image is developed by a developing device 36, and is transferred to paper, which is fed from a source 38, as the paper passes between the photosensitive drum 32 and a backup roller 40. The paper then travels past a fixing device 42 and out of the printer by various conveying rollers and guides. As with the photocopying apparatus, if the photosensitive drum 32 is not properly grounded, inferior images can result, which can result in an overall perception of poor product quality.

Although the drawings show preferred embodiments of the image forming apparatuses, it is to be understood that the grounding plate assembly can be used with a variety of image forming apparatuses, including, for example, digital copiers/laser printers.

Figure 3:
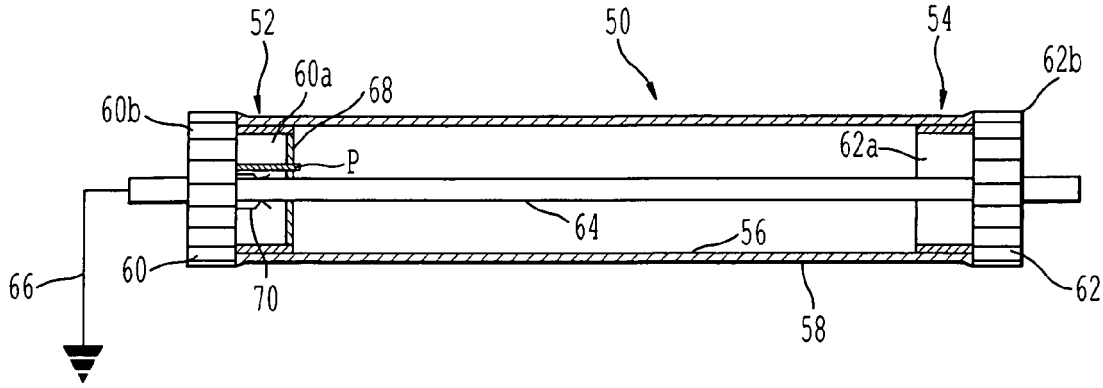
FIG. 3 is a partially cross-sectioned view of a photosensitive drum of the present invention.

Referring now to FIG. 3, a photosensitive drum assembly in accordance with the present invention is shown, in which portions of the drum and interiorly disposed portions of the drum flanges are shown in cross-section. The drum 50 is formed as a hollow tubular member having a first end 52 and a second end 54, with the drum further having an interior surface 56 and an exterior surface 58. Flanges 60 and 62 are inserted into each of the first and second ends 52 and 54 of the drum 50, and the flanges each include a first portion 60*a* and 62*a* disposed inside of the drum, and a second portion 60*b* and 62*b* disposed outside of the drum. The interiorly disposed first portions 60*a* and 62*a* are fastened to the drum utilizing, for example, an adhesive, and preferably a tight fit or an interference fit is provided between the first portions 60*a* and 62*a* and the interior surface 56 of the drum 50. It is also possible to fasten or connect the flanges to the drum without an adhesive (e.g., with an interference fit). Further, as discussed below, because of the characteristics of the grounding plate assembly 68, the flange 60 can be fastened to the drum 50 without additional securement. One or both of the second exteriorly disposed portions 60*b* and 62*b* typically have gear surfaces formed thereon. The gear surfaces are utilized to receive a driving force for driving the drum, and also to impart a driving force for driving other components. For example, the gear on portion 60*b* can receive a driving force from a drive gear of the image forming apparatus in order to rotate the drum 50. The gear on portion 62*b* can then be utilized to provide a driving force for other components by coupling the gear 62*b* to a drive gear of another component, such as a paper feed roller. Thus, the flange 60 can receive a driving force for rotating the drum, and the flange 62 can deliver a driving force for driving a paper feed device. Although the gears 60*b*, 62*b* are represented as spur gears, it is to be understood that various gear configurations can be utilized, and the present invention is not limited to particular gears utilized on the flanges of the drum. It is also possible to utilize the present invention with a drum flange which does not have a gear surface formed on the flange.

The flanges 60 and 62 each have an aperture extending therethrough for receiving a support shaft 64, upon which the drum 50 is rotatably mounted. Although the shaft 64 is depicted as a complete shaft, i.e., it extends completely through the drum, partial shaft arrangements are also known, in which shaft portions or pins extend through each flange and into each end of the drum, but they do not extend for the full length of the drum. The present invention can be utilized with either partial or full shaft assemblies. As schematically represented at 66, the shaft 64 is grounded, to thereby ground the photosensitive drum 50. To provide a connection between the interior surface 56 of the drum 50 and the shaft 64, a contact assembly or grounding assembly 68 is provided as will be discussed in further detail hereinafter. In the presently preferred form, the contact assembly 68 is provided as a metal (e.g., copper) grounding plate which is fastened to one of the flanges, and the flanges are formed of plastic. However, it is to be understood that various other expedients are possible. For example, the grounding/contact assembly can be formed as one piece with the flange, and portions of the contact/grounding assembly and/or flange can be formed of metal or conductive plastics. As shown in FIG. 3, in a presently preferred form, the grounding plate assembly 68 includes inwardly projecting contact members or tongues 70, which make contact with the shaft 64. In addition, as shown in FIG. 6 and as will become further apparent from the discussion which follows, the grounding plate assembly 68 also includes radially outwardly projecting contact members 101–105 which contact the interior surface 56 of the drum 50 and remove an electrically resistive coating therefrom. Often, portions of the tube which are disposed interiorly of the ends (i.e., toward the longitudinal center of the drum) will have a reduced inner radius so that a ridge will be formed (not shown). This ridge or transition to a reduced inner radius of the drum can be provided to limit adhesive flow (if an adhesive is utilized) into the longitudinally interior portions of the tube to avoid any adverse effects upon the performance of the drum and/or to limit movement of the flanges upon insertion into the drum.

In the past, one or two radially protruding contact members have been provided on the grounding plate which is attached to the drum flange. When the flange is inserted into the drum, one of the contact members must be aligned, so that it is lined up with a scribed contact area of the drum. Such an arrangement is less than optimal for a number of reasons. For example, if the flange is inserted manually, the contact member of the grounding plate might not be suitably aligned as a result of inattentive labor. Further, if the contact member is properly inserted, the flange might rotate within the drum during subsequent handling. Typically, the flange is sized so that it is tightly fit into the drum, and thus, will not rotate. However, due to manufacturing variation, it is possible that a flange could rotate within the end of the drum before an adhesive utilized in securing the flange to the drum has cured. U.S. Pat. No. 5,845,173 provides a scribed area and a number of contact elements such that alignment is not needed, however, this arrangement still requires pre-scribing prior to insertion of the grounding plate.

The present invention avoids the above shortcomings. In particular, the present invention provides a series of contact members which contact the inner periphery of the drum, one or more of the contact elements configured to remove an anodized layer (or other coatings or oxidized surfaces which reduce conductivity) on the interior surface 56 of the drum 50, thereby reducing or eliminating the need to scribe the interior surface 56. Further, the contact members prevent rotating of the grounding plate assembly 68 and the flange 60 relative to the drum 50. Thus, the arrangement of the invention can be advantageous in that it can be utilized without pre-scribing of the drum interior. Further, if pre-scribing is used, the arrangement is less prone to inferior performance resulting from a poor scribing operation, poor positioning of the grounding plate with respect to the scribe and/or poor grounding that can be caused by subsequent movement of the grounding plate with respect to the drum.

Figure 4:
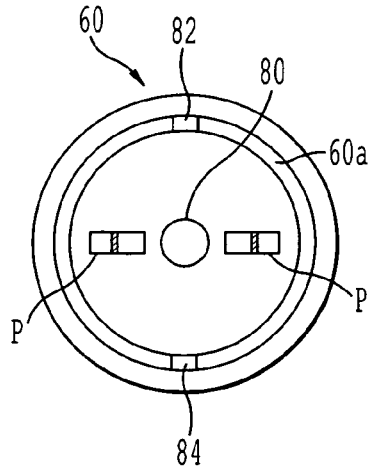
FIG. 4 is a plan view of a flange.

Referring briefly to FIG. 4, an end view of a flange (without the grounding assembly) is shown. As discussed earlier, such a flange 60 will have an aperture 80 through which a support shaft 64 can extend, and the support shaft 64 can also be utilized for grounding the photosensitive drum. The first portion 60*a* of the flange 60 which extends into the drum is often provided with recesses 82 and 84 in the form of slots which extend from the longitudinally innermost end (i.e., the end of the flange which extends farthest into the drum) of the flange. These recesses 82 and 84 allow the flange to be formed of a relatively rigid material, while also allowing the inner portion 60*a* of the flange to yield to allow insertion of the flange into the drum and ensure that the flange is tightly held within the drum. Projecting pins P can extend from the flange and are utilized for fastening the grounding plate to the flange (one of the pins P is also represented in FIG. 3). The pins P can be formed of the same plastic material as that of the flange, and the pins P allow the grounding plate to be properly positioned with respect to the flange utilizing apertures which are formed in the grounding plate. Once the pins P are received by apertures of the grounding plate, the head of the pins can be heated to flatten the heads of the pins, and thus prohibit removal of the grounding plate from the pins so that the grounding plate is fastened to the flange. It is to be understood, however, that other expedients are also possible for fastening or connecting the grounding plate or contact assembly of the present invention to a drum flange.

Figure 5:
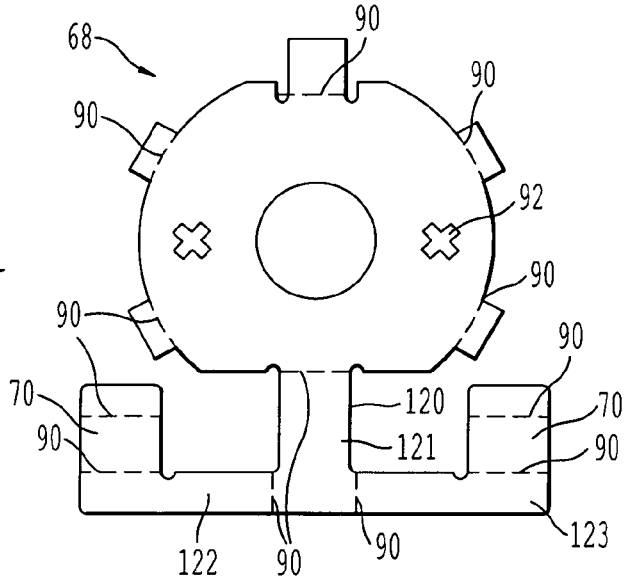
FIG. 5 depicts a grounding or contact assembly of the present invention in its "as cut" form.
Figure 6A:
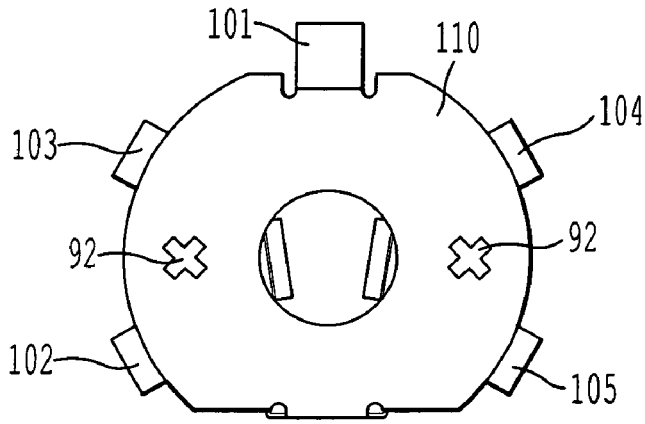
FIGS. 6A and 6B illustrates top and bottom views, respectively, of a preferred form of the grounding or contact assembly of the present invention of FIG. 5 after bending.
Figure 6B:
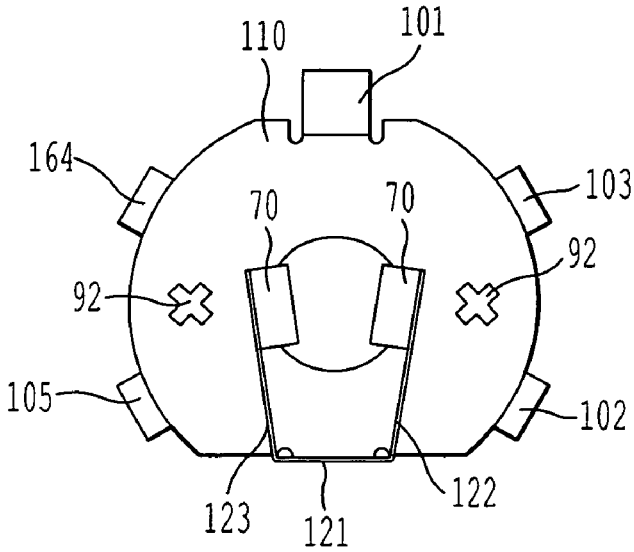
Figure 7:
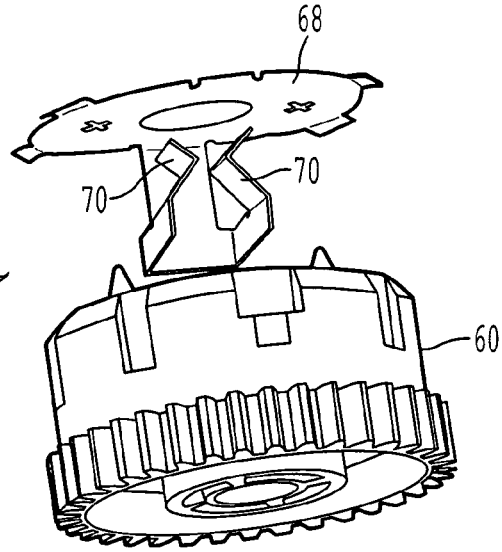
FIG. 7 is an exploded isometric view of the grounding assembly and the flange of FIG. 4.
Figure 8:
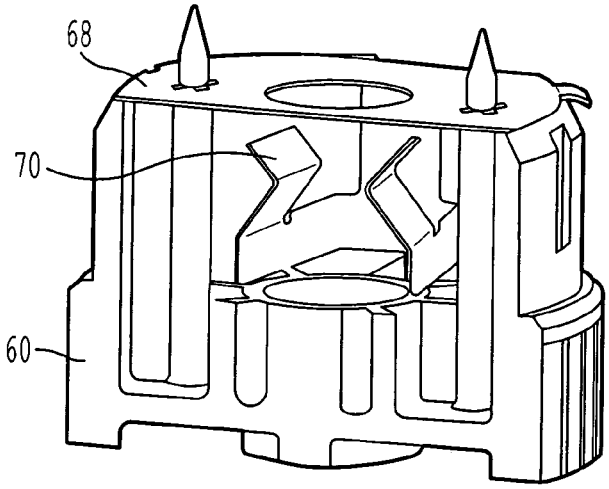
FIG. 8 is a cross-sectioned view of the grounding assembly and the flange of FIG. 4.

FIG. 5 illustrates a contact assembly or grounding plate of the present invention. In the presently preferred form, the grounding plate can be stamped from conductive metal sheet formed, for example, of copper or a copper alloy. FIG. 5 depicts the stamp cut form of the grounding plate assembly, i.e., in the configuration after the grounding plate is cut from sheet metal and before any shaping or bending steps. The broken lines 90 of FIG. 5 represent locations at which the grounding plate 68 is to be bent in the final forming operation. FIGS. 6–8 provide various views of the grounding plate assembly 68 after the shaping/bending operations. This shaping/bending can occur in a single stamping step, or if desired, multiple shaping operations can be performed. FIGS. 6A and 6B are top and bottom views as shown in FIG. 5, however after the shaping/bending has taken place. FIG. 7 is an exploded isometric view of the grounding assembly and the flange, and FIG. 8 is a cross-sectioned view of the grounding assembly and the flange.

As shown in FIGS. 5, 6A, and 6B, apertures 92 extend through the grounding plate 68 so that the apertures 92 can receive the pins P discussed earlier for positioning and fastening of the grounding plates to the flanges of the drum. As also discussed earlier, different fastening expedients are also possible, and it is also possible to form the grounding plate integral with or molded with the flange if desired. In the presently preferred form, five radially outwardly extending contact members 101–105 are provided. The contact members are of a size such that they can be bent and remain sufficiently yieldable such that they be inserted (with the flange) into an end of the drum to ensure contact with the interior surface of the drum.

As shown in FIGS. 5, 6A, and 6B, a first contact member 101 can have a radial length larger than that of the other contact members 102–105. (The radial length before bending is shown at 101L in FIG. 5). The contact member 101 can accommodate for the provision of one of the recesses 82, 84 in the flange 60, since the flange will provide less support to the grounding plate assembly at the recess locations 82, 84. Thus, the grounding plate is able to accommodate for the possibility of additional deflection in the locations adjacent to the recesses 82, 84 of the flange. As shown in FIGS. 6A, 6B, and 7, each of the contact members 101–105 is preferably bent, so that once the grounding plate is inserted into the drum, the contact member can deflect further to allow for insertion, and after insertion into the drum, the contact members 101–105 will thus be biased outwardly to ensure that they remain in contact with the interior surface of the drum, thereby preventing rotation of the grounding plate assembly 68 and the flange 60 relative to the drum 50.

Further, one or more of the contact members 101–105 can be configured to remove an anodized layer (or other coatings or oxidized surfaces which reduce conductivity) on the interior surface 56 of the drum 50. In a preferred embodiment of the invention, at least one of the contact members 101–105 is configured to remove such a layer. Insertion of the grounding plate assembly 68 with the longer contact member 101 results in a concentration of a force on the interior surface of the drum, thereby removing the layer such that satisfactory grounding can be achieved. By this arrangement, the grounding assembly 68 can reduce or eliminate the need to scribe the interior surface 56 of the drum 50. Although the preferred embodiment of the invention includes at least one contact member 101–105 to remove the anodized layer, it is to be understood that any of the contact members can be configured to remove the coating by various configurations, such as a sharpened surface of the contact member.

As also shown in FIGS. 5–8, the grounding plate assembly 68 includes radially inwardly extending contact members 70 that can be bent so that when the drum 50 is mounted onto the shaft 64, the radially inwardly extending contact members (or tongues) 70 can be urged or deflected radially outwardly by the shaft 64, with the result that the tongues 70 are biased or urged in a radially inward direction to thereby ensure that the tongues 70 are maintained in contact with the shaft 64.

In the embodiment of the invention shown in FIGS. 5–8, the contact members (or tongues) 70 are disposed within the flange 60. Thus, the flange 60 can prevent damage to the grounding plate assembly 68, including the contact members 70, when the grounding plate assembly 68 is shipped, installed, or otherwise handled with the flange 60.

As shown in FIGS. 5–8, a preferred embodiment of the grounding plate assembly 68 has a plate portion 110, which includes the contact members 101–105, as well as a shaft portion 120. The plate portion 110 is preferably flat before and after the bending/shaping of the grounding plate assembly 68, except for the contact members 101–105, which are bent in the manner described above. The shaft portion 120 preferably includes first through third portions 121–123, as well as the contact members 70. The first portion 121 is connected with the plate portion 110 and extends perpendicular to the plate portion 110 after the bending/shaping of the grounding plate assembly 68. The second and third portions 122, 123 extend at an angle to the first portion 121 and opposite to one another after the bending/shaping of the grounding plate assembly 68, such that the shaft 64 is disposed within a "V" or "U" shaped opening. The inwardly projecting contact members (or tongues) 70 are connected to the second and third portion 122, 123, and contact the shaft 64. Free ends of the contact members 70 are disposed between the plate portion 110 and the second and third portions 122, 123. As discussed above, the shaft portion 120, including the contact members 70, are preferably disposed within an interior of the flange 60.

Figure 9:
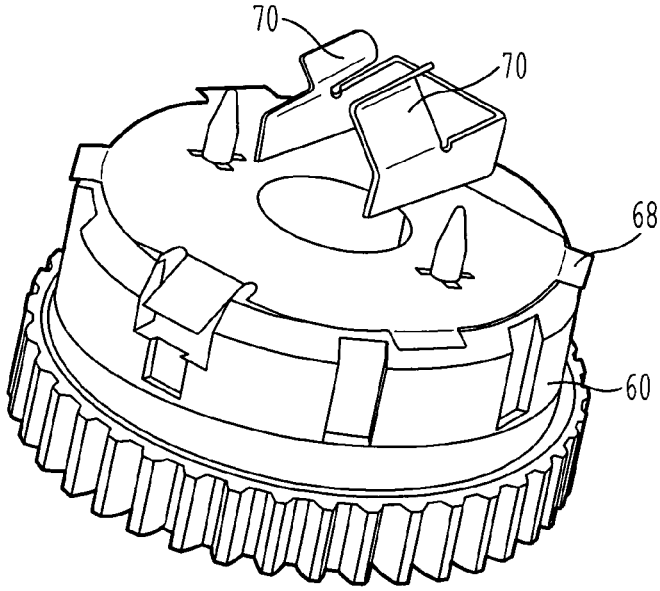
FIG. 9 is an isometric view of another embodiment of the grounding assembly and the flange.

FIG. 9 shows another embodiment of the invention, where the contact members (or tongues) 70 are disposed outside of the flange 60. It is understood that this embodiment can be obtained by bending portions of the grounding plate assembly 68 in an opposite direction to the embodiment of the invention shown in FIGS. 5–8. In a preferred embodiment, the free ends of the contact members 70 are disposed above both the plate portion 110 and the second and third portions 122, 123.

It will thus be appreciated that the present invention provides an improved contact assembly or grounding plate for an image forming apparatus such as a printer or photocopier. The present invention is advantageous in ensuring desirable contact between a grounding plate (or contact assembly), the interior surface of the drum, and a grounding shaft, despite various deflections or bending which can occur as a result of: (1) contact between radially outwardly extending contact members of the grounding plate and the interior surface of the drum, (2) contact between the radially inwardly extending contact members and the grounding shaft, and (3) recesses formed in the flange with which the grounding plate assembly is associated.

Numerous modifications and variations of the present invention are possible in light of the above teachings. It is therefore to be understood that, within the scope of the appended claims, the invention may be practiced otherwise than as specifically described herein.

What is claimed is:

1. A photosensitive drum assembly for an image forming apparatus, comprising:

a drum defining first and second open ends;

a flange partially disposed in the first open end; and a grounding plate assembly comprising a plate member including a void configured to receive a grounding shaft therein, a drum contact member configured to remove an electrically resistive coating from an interior of the drum, the drum contact member connected to an outer periphery of the plate member, and at least two shaft contact members configured to contact the grounding shaft disposed therebetween, the shaft contact members disposed entirely within an interior of the flange, and the shaft contact members connected to an intermediate member connected to the outer periphery of the plate member.

2. The photosensitive drum assembly according to claim 1, further comprising:

a shaft disposed through the void defined in the flange, the shaft and the grounding plate providing a grounding path for the interior of the drum.

3. The photosensitive drum assembly according to claim 2, wherein the grounding plate comprises a plurality of drum contact members, at least one of the drum contact members configured to remove the electrically resistive coating.

4. The photosensitive drum assembly according to claim 3, wherein at least one of the drum contact members has a length longer than the other drum contact members.

5. The photosensitive drum assembly according to claim 1, wherein the plate member comprises a conductive plate including the outer periphery, and the grounding plate assembly comprises a plurality of drum contact members radially protruding from the outer periphery of the conductive plate.

6. The photosensitive drum assembly according to claim 5, wherein the plurality of drum contact members comprises at least three circumferentially spaced drum contact members.

7. The photosensitive drum assembly according to claim 6, wherein the plurality of drum contact members comprises at least five circumferentially spaced drum contact members, and wherein a first one of the drum contact members has a first length, and a pair of the drum contact members has a second length, and wherein the first length is larger than the second length.

8. The photosensitive drum assembly according to claim 7, wherein the flange defines a first recess, and wherein the first drum contact member is disposed adjacent to the first recess.

9. The photosensitive drum assembly according to claim 1, wherein the plate member comprises a planar portion, and the grounding plate assembly comprises a plurality of drum contact members bent relative to the planar portion.

10. The photosensitive drum assembly according to claim 1, wherein at least one of the shaft contact members is bent.

11. The photosensitive drum assembly according to claim 10, wherein the at least two shaft contact members comprise two shaft contact members extending from the intermediate member.

12. The photosensitive drum assembly according to claim 11, wherein the two shaft contact members are bent.

13. The photosensitive drum assembly according to claim 12, wherein free ends of the two shaft contact members are disposed between a surface of the interior of the flange and a planar surface of the grounding plate.

14. The photosensitive drum assembly according to claim 1, wherein the flange comprises a gear surface.

15. The photosensitive drum assembly according to claim 14, wherein the flange comprises a plastic and the grounding plate comprises a metal.

16. The photosensitive drum assembly according to claim 1, wherein the flange comprises a gear surface formed on a portion disposed outside of the drum, and wherein the flange defines an aperture configured to receive a grounding shaft.

17. An image forming apparatus including a drum assembly, the drum assembly comprising:

a drum defining first and second open ends;

a flange disposed in the first open end; and a grounding plate assembly comprising a plate member including a void configured to receive a grounding shaft therein, a drum contact member configured to remove an electrically resistive coating from an interior of the drum, the drum contact member connected to an outer periphery of the plate member, and at least two shaft contact members configured to contact the grounding shaft disposed therebetween, the shaft contact members disposed entirely within an interior of the flange, and the shaft contact members connected to an intermediate member connected to the outer periphery of the plate member.

18. The image forming apparatus according to claim 17, wherein the grounding plate comprises a plurality of drum contact members, wherein at least one of the drum contact members has a length longer than the other drum contact members.

19. The image forming apparatus according to claim 17, wherein the plate member comprises a conductive plate including the outer periphery, and the grounding plate assembly comprises a plurality of drum contact members radially protruding from the outer periphery of the conductive plate.

20. The image forming apparatus according to claim 19, wherein the drum contact members comprises at least five circumferentially spaced contact members, and wherein a first one of the drum contact members has a first length, and a pair of drum contact members has a second length, and wherein the first length is larger than the second length.

21. The image forming apparatus according to claim 20, wherein the flange defines a first recess, and wherein the first drum contact member is disposed adjacent to the first recess.

22. The image forming apparatus according to claim 17, wherein the plate member comprises a planar portion, and the grounding plate assembly comprises a plurality of drum contact members bent relative to the planar portion.

23. The image forming apparatus according to claim 17, wherein the flange comprises a gear surface.

24. The image forming apparatus according to claim 23, wherein the gear surface is formed on a portion of the flange disposed outside of the drum.

25. The image forming apparatus according to claim 17, wherein at least one of the shaft contact members is bent.

26. The image forming apparatus according to claim 25, wherein the at least two shaft contact members comprise two shaft contact members extending from the intermediate member.

27. The image forming apparatus according to claim 26, wherein the two shaft contact members are bent.

28. The image forming apparatus according to claim 27, wherein free ends of the two shaft contact members are disposed between a surface of the interior of the flange and a planar surface of the grounding plate.

29. A photosensitive drum assembly for an image forming apparatus, comprising:

a drum defining first and second open ends;

a flange partially disposed in the first open end; and a grounding plate assembly comprising a plate member including a void configured to receive a grounding shaft therein, a plurality of drum contact members one of the drum contact members being longer than the other drum contact member, the plurality of drum contact members connected to an outer periphery of the plate member, and at least two shaft contact members configured to contact the grounding shaft disposed therebetween, the shaft contact members disposed entirely within an interior of the flange, and the shaft contact members connected to an intermediate member connected to the outer periphery of the plate member.

* * * * *